US006126883A

United States Patent [19]

Troetscher et al.

[11] Patent Number: 6,126,883

[45] Date of Patent: Oct. 3, 2000

[54] METHOD AND APPARATUS FOR COOLING HOT-PRESSED PANELS, ESPECIALLY WOOD CHIP AND FIBER PANELS

[75] Inventors: Gerhard Troetscher, Weissensberg; Josef Krill, legally incapacitated, Siegburg; Ernst-Dieter Grafe, Troisdorf, all of Germany

[73] Assignee: Lindauer Dornier Gesellschaft mbH, Lindau, Germany

[21] Appl. No.: 09/191,676

[22] Filed: Nov. 13, 1998

[30] Foreign Application Priority Data

Nov. 17, 1997 [DE] Germany ..... 197 50 847
May 12, 1998 [DE] Germany ..... 198 21 153

[51] Int. Cl.[7] ..... B27N 3/18

[52] U.S. Cl. ..... 264/348; 264/109; 425/407

[58] Field of Search ..... 264/109, 118, 264/348, 40.7; 425/143, 407

[56] References Cited

U.S. PATENT DOCUMENTS 4,957,671 9/1990 Morris ..... 425/407
5,008,057 4/1991 Risius et al. .

FOREIGN PATENT DOCUMENTS 0255950 2/1988 European Pat. Off. .
4244367 6/1994 Germany .
62-001501 1/1987 Japan .
6-293009 10/1994 Japan .
2232634 12/1990 United Kingdom .

*Primary Examiner*—Mary Lynn Theisen
*Attorney, Agent, or Firm*—W. F. Fasse; W. G. Fasse

[57] ABSTRACT

A method of cooling hot-pressed panels, such as wood chip or fiber board panels or sheets, includes a first step in which the panels are intensively cooled from an initial temperature above 100° C. down to a temperature of about 100° C. by means of cooling water, a second step in which the panels are further cooled to a temperature below 60° C. by using cooling air, and a third step of reconditioning the panels by exposing the panels to a vapor mixture of steam and volatile binder components that was evolved during the first step. The third reconditioning step can begin and take place already during the first cooling step, or between the first and second cooling steps. An apparatus for carrying out the method includes a hot press apparatus, a first cooling arrangement for applying cooling water to the panels, a second cooling arrangement for applying cooling air to the panels, a reconditioning zone for exposing the panels to a vapor mixture arising during the first cooling step, and a conveyor device for transporting the panels through the apparatus. In this manner, the total time required for cooling the panels is substantially reduced.

37 Claims, 6 Drawing Sheets

METHOD AND APPARATUS FOR COOLING HOT-PRESSED PANELS, ESPECIALLY WOOD CHIP AND FIBER PANELS

PRIORITY CLAIM

This application is based on and claims the priorities under 35 U.S.C. §119 of German Patent Applications 197 50 847.2-44, filed on Nov. 17, 1997, and 198 21 153.8, filed on May 12, 1998, the entire disclosures of which are incorporated herein by reference.

FIELD OF THE INVENTION

The invention relates to a method of cooling hot-pressed panels such as wood chip and fiber panels, whereby the panels are cooled in a stepwise manner from a surface temperature above 100° C. to a surface temperature of less than 70° C. The invention further relates to an apparatus for carrying out the method, including a continuously or discontinuously operating panel press, a panel conveyor device arranged after or downstream of the panel press, and at least one cooling path through which the panels are conveyed, as well as control means for controlling and regulating the cooling process.

BACKGROUND INFORMATION

According to the state of the art, fiber panels and/or wood chip panels are fabricated from a great variety of material compositions, which include panels made of wood chips or fibers held together by a binder, commonly known in the trade as oriented strand board (OSB) and medium density fiber board (MDF) panels. Such products may be in configurations designated as sheets, boards, panels, or the like, which are all generally termed "panels" throughout this specification.

In manufacturing such panels, the fibers or chips are mixed with the binder to form a moldable mass, which is then supplied to a former such as a sheet extruder. The former forms the moldable mass into an intermediate product such as an extruded sheet or band, which is then pressed in a heated press apparatus. During a predetermined pressing time, using a relatively high temperature, the pre-formed material composition is continuously or discontinuously hot-pressed into the form of panels or an endless band-shaped web. Thereafter, the material is either directly unloaded or first conveyed to a saw, the edges of the panels are squared and trimmed, and then the panels are conveyed, for example by a roller table, to a set of star wheels or turning devices. From the turning devices, the panels are conveyed over a second roller table to a stacker, and finally the panels are stored in an intermediate storage facility.

Directly after the hot-pressing of the panels, the outer surface of each panel has a temperature of more than 100° C., and especially at least 110° C., or even more than 120° C. Thus, it is necessary to cool the material after the hot-pressing operation, in view of handling and quality requirements. The cooling of the panels already begins while the edges of the panels are being squared and trimmed. The cooling of the panels continues while the panels are being conveyed to the so-called star wheels or turning devices. Thus, depending on the respective thickness of each panel, the panels leave the cooling process with a panel temperature of about 60 to 80° C. The cooling medium is conventionally air, which removes heat from the panel surfaces in a purposeful and targeted manner or a passive manner.

The conventional cooling process requires a relatively long time duration, depending on the thickness of the respective panel. Typically, after leaving the equipment at a temperature between 60° C. and 80° C. (intermediate panel temperature), the panels cool further to a normal room temperature by themselves, i.e. without any further active cooling efforts, while the panels are intermediately stored. This final cooling can take several days before the panels are cooled to normal room temperature. Such a long cooling time requires a corresponding large storage capacity for the intermediate storage of the panels. Namely, since it takes several days for the panels to completely cool down, the storage capacity of a panel manufacturing plant must be sufficient to store several days worth of the total output capacity of the plant. For cost reasons, such a large storage capacity should be avoided. Moreover, the structural length of the panel manufacturing equipment must also be rather long to provide sufficient time for the initial cooling of the panels, such that the length of the plant from the hot press to the last star wheel can amount to 80 meters, which is a further disadvantageous cost factor.

Another factor that must be considered is the desire to reduce the extent to which the panel manufacturing process impacts the environment. In this regard, it is a serious disadvantage of the conventional processes, that a considerable quantity of volatile binder vapors, such as formaldehyde and urea vapors, as well as dust and the like are released into the atmosphere during the rather long time period required for reducing the temperature of the panel surfaces to approximately 100° C. Efforts to recover and reprocess the environmentally damaging binder vapors, dust and other harmful materials is quite costly, cumbersome, and not adequately effective.

Moreover, further disadvantages have resulted in practice due to the non-uniform removal of heat from the panels, leading to a non-uniform panel surface temperature in the cooling path from the panel press to the star wheels and in the star wheels themselves. This non-uniform panel temperature disadvantageously leads to warping of the panels, which requires a considerable post-processing effort, for example grinding, sanding, re-pressing or re-laminating in order to produce an acceptable marketable product.

In summary of the above, the known or conventional methods as described above suffer the following disadvantages:

a) the cooling time required for adequately cooling the panels is too long;

b) the process results in a considerable impact on the environment through the process exhaust gases, which include after-vaporized binder components as well as process dust; and c) it is not possible to achieve a uniform removal of the surface heat from the panels.

SUMMARY OF THE INVENTION

In view of the above, it is an object of the invention to provide a method and an apparatus for cooling hot-pressed panels, whereby the disadvantages of the prior art can be avoided. Namely, the invention aims to provide a more compact, quicker and more uniform cooling of the panels, while reducing the environmental loading or impact caused by the process. The invention further aims to achieve additional advantages, as apparent from the present description.

The above objects have been achieved in a method of cooling hot-pressed panels or a hot-pressed continuous band that is to be later cut into panels, according to the invention, including a first cooling step in which a surface of the panel is cooled from an initial temperature of at least 110° C. to an intermediate surface temperature of about 100° C. using water during a first time period, and a second cooling step of further cooling the surface of the panel to a final surface temperature below 60° C. using air during a second time period. During the first cooling step, a vapor mixture is generated, including saturated steam and volatile components of the binder used in the panels. The method further includes a third step in which the cooled panels are reconditioned, e.g. treated to have a desired finished moisture content, by being exposed to the vapor mixture.

The above objects have further been achieved using an apparatus for cooling panels according to the invention, including a hot panel press, a panel conveyor device arranged after or downstream of the panel press, a cooling path through which the panels are conveyed on the conveyor device, and means for controlling and regulating the cooling process, wherein the cooling path comprises at least one first cooling arrangement, at least one second cooling arrangement located downstream of the first cooling arrangement, and a reconditioning zone.

An important feature of the invention is that the surface of the panels is cooled rather intensively in a first method step, from an initial temperature over 100° C. to a temperature of about 100° C. by directly cooling the panel surface with water. Throughout this specification, the term "about" in connection with recited temperatures means a range of ±5° C., so that "about 100° C." means "95° C. to 105° C." Through the use of such an intensive cooling step, the total cooling time required for cooling the panels is considerable reduced, and the length of the cooling path can be significantly reduced or minimized. This cooling step can be carried out in various ways, for example by spraying the cooling water onto the panel surface, by conveying the panel through a water bath, by applying a cooling medium onto the panels by means of a roller pair onto which the cooling medium is applied, or by indirect cooling, for example provided by cooled endless rotating metal bands. The cooling "water" may be any water-based cooling medium, which may further contain any one or more of a wetting agent, an anti-foaming agent, a film-forming agent, a vaporization control agent, or the like, as well as unintentional constituents.

The intensive water cooling achieves the advantage that the postheating vaporization of the volatile binder components from the panels is almost completely stopped after a relatively short period of time, because this vaporization of the binder components only takes place in a temperature range from approximately 160° C. down to 100° C. Thus, once the panels are cooled to 100° C. or lower, essentially no further evaporation of the volatile binder components will take place. Furthermore, the direct application of cooling water simultaneously achieves the advantage that a considerable portion of the process dust will be bound up and carried away by the water flow.

In the second method step, the panel surface is further cooled to a temperature of less than 70° C. and especially less than 60° C., using cooling air blown onto the panels from air nozzles, following the intensive water cooling step. The air cooling effect in this second step is enhanced by the evaporation of the water remaining on the panels from the first cooling step. This second step especially serves to ensure that a very uniform removal of the heat from the panel is achieved, in that the cooling air is actively blown onto the surface of the panel in a targeted and uniformly distributed manner, namely using blowing nozzles distributed across the width of the panel. The cooling arrangement for carrying out this second method step may be embodied as a multi-storied or multi-level cooling arrangement in the interest of shortening the overall length of the production plant. The second cooling arrangement can be equipped with means for delivering the cooling air to the panels either directly from the atmosphere or from an air chiller or other cooling air plant, or indirectly through one or more heat exchangers.

According to a further advantageous improvement of the inventive method, especially in view of the proper reconditioning of the panels to have the desired moisture content and the like in the finished product, the method further includes a reconditioning step, which may take place during a third time period $t_3$ between the end of the first cooling step and the end of the second cooling step, or at least partially during the first cooling step, or between the two cooling steps. In this further step, the panels are subjected to a vapor mixture comprising saturated steam and volatile binder components that arose during the first time period $t_1$ of the first cooling step.

It is particularly advantageous if the reconditioning of the panels already begins during the first cooling step. In such a case, the vapor mixture is not sucked away during the first step, but instead the panels remain exposed to the vapor mixture for the duration of the third time period $t_3$, which begins during the first time period $t_1$ of the first step. The duration of the third time period $t_3$ is set dependent upon the thickness s of the panels. However, in any case, the third time period $t_3$ is shorter than the second time period $t_2$ during which the second step is carried out.

BRIEF DESCRIPTION OF THE DRAWINGS

In order that the invention may be clearly understood, it will now be described in connection with example embodiments, with reference to the accompanying drawings, wherein.

Figure 1:
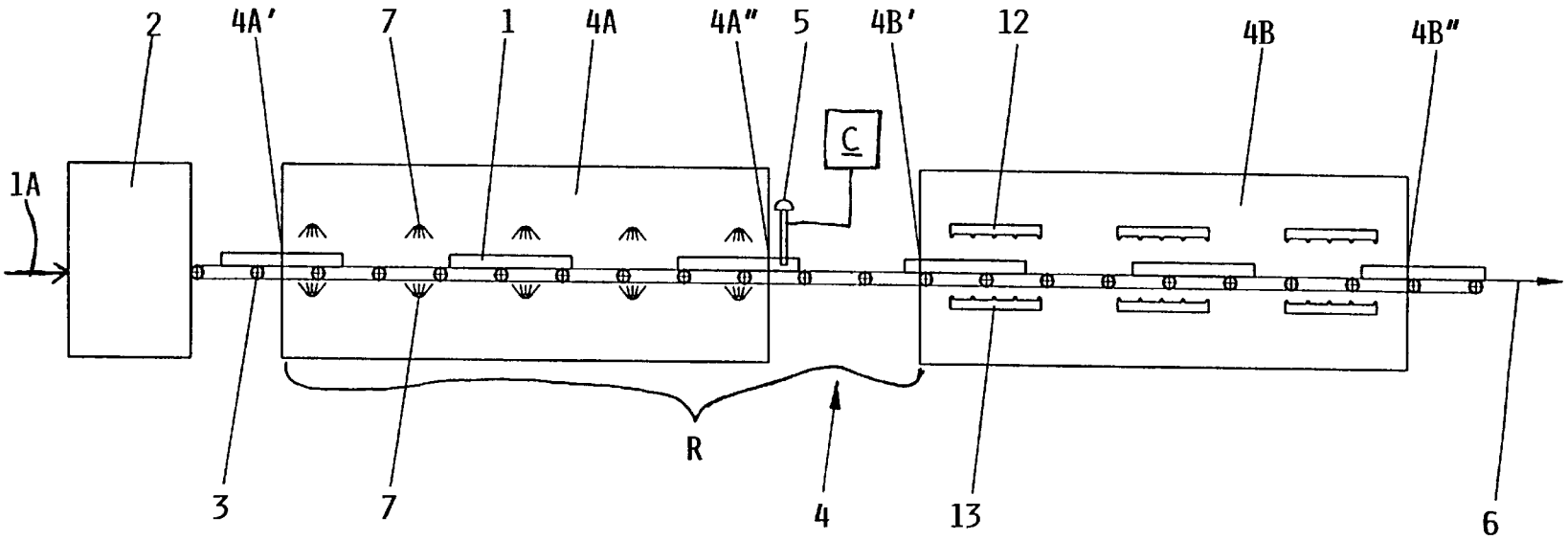
FIG. 1 is a schematic sectional side view of an apparatus for carrying out the method according to the invention, in which the first cooling arrangement includes a water spray nozzle arrangement, and the second cooling arrangement includes an air nozzle arrangement.

DETAILED DESCRIPTION OF PREFERRED EXAMPLE EMBODIMENTS AND OF THE BEST MODE OF THE INVENTION

With general reference to FIGS. 1 to 5, a mixture 1A, for example comprising wood chips and a binder, is supplied to a hot panel press 2 in a continuous or discontinuous manner using any known apparatus. The press 2 forms and presses the mixture 1A into individual panels 1 or a flat continuous band-shaped web that will later be cut into individual panels 1. The panels 1 or continuous web are loaded onto a transport or conveyor device 3, such as a roller table for example, in a transport plane 6 directly after or downstream from the press 2. The hot pressed panels 1 have a thickness in the range from about 5 mm to 16 mm or even more, for example, and leave the press 2 having an initial panel surface temperature $T_1$ of more than 100° C. and especially at least 110° C. In order to reduce the relatively long cooling time that is required according to the known state of the art, the invention provides that the hot panels are transported by the conveyor device 3 through a cooling path 4 that comprises two separate cooling stations or cooling arrangements, namely a first so-called intensive cooling arrangement 4A and a subsequent, less intensive second cooling arrangement 4B.

In all of the embodiments according to FIGS. 1 to 5, the first cooling arrangement 4A includes a cooling chamber enclosed by a housing that has an inlet 4A' and an outlet 4A" for the panels 1.

The conveyor device 3 runs through the cooling chamber essentially in the middle of the cooling path 4 so as to form the transport plane 6 for the panels 1. In the particular embodiment according to FIG. 1, the first cooling arrangement 4A includes rows of cooling water spray nozzles 7 arranged above and below the transport plane 6 and distributed over the length and the width of essentially the entire cooling chamber, whereby the nozzles 7 are oriented to spray the cooling water directly onto the respective upper and lower surfaces of the panels 1. In this context, the cooling water is sprayed from the nozzles 7 at a prescribed pressure and volume flow rate, depending on the required cooling capacity, to impinge on the surfaces of the panels 1 and thereby cool the panel surfaces during a first time duration $t_1$ while forming a steam or vapor mixture of saturated water steam and volatile binder components.

The equipment further preferably includes a reconditioning zone R integrated between or in the first cooling arrangement 4A and the second cooling arrangement 4B that will be described below. The steam or water vapor mixture arising in the first cooling arrangement 4A during the time $t_1$ is supplied into the reconditioning zone and brought into contact with the panels 1, such that the panels are subjected to a reconditioning step for adjusting the final moisture content thereof, for example. The panels are left in contact with the vapor mixture for a time duration $t_3$ that is shorter than the time duration $t_2$ of the secondary cooling process of the panels 1 that takes place in the second cooling arrangement 4B as will be described below.

It is particularly advantageous for the method according to the invention, if the steam or vapor mixture is already allowed to be effective on the panels 1 during the intensive cooling process, i.e. within the first cooling arrangement 4A. In this case, the reconditioning zone R is formed within or by the cooling chamber of the first cooling arrangement 4A, in that the steam or vapor mixture evolving during the cooling process is not immediately removed from the cooling chamber in the first cooling arrangement 4A, but instead is allowed to remain in contact with the panels 1. After the reconditioning process has been allowed to continue for the required time period $t_3$, the steam or vapor mixture is removed from the cooling chamber by any known means including blowers or fans and the like to convey the steam mixture through corresponding ducts. Preferably further, the steam mixture is then conveyed through any known devices for removing toxic or environmentally dangerous components from the steam mixture.

At least one temperature measuring device 5, which may be any known temperature sensor such as an IR temperature sensor, is arranged at the outlet 4A" of the first cooling arrangement 4A for detecting and measuring the surface temperature of the panels 1 as they exit from the outlet 4A". Another sensor may be arranged at the outlet 4B" of the second cooling arrangement 4B described below. The temperature information provided by the temperature measuring device 5 is supplied to a controller C that controls or regulates the process parameters of the operation of the first cooling arrangement 4A and/or the second cooling arrangement 4B dependent on the measured temperature data. For example, the controller C will adjust the rate of delivery of the cooling medium and/or the transport speed of the panels 1 through the apparatus. Instead of, or in addition to, the temperature sensors, the apparatus may include other sensors such as humidity or moisture sensors for providing corresponding data to the controller C.

The apparatus further includes a second cooling arrangement 4B that generally includes a cooling chamber enclosed in a housing similarly to the first cooling arrangement 4A, having an inlet 4B' and an outlet 4B" for the panels 1. In the particular embodiments of FIGS. 1 to 4, the second cooling arrangement 4B further includes several rows of air nozzle arrangements 12 and 13 that are arranged in the cooling chamber above and below the transport plane 6 and distributed over the inner width and length of the cooling chamber. The nozzle openings or outlets of the air nozzles are directed toward the respective upper and lower panel surfaces. The air nozzle arrangements 12 and 13 are connected to ambient air ventilators to provide the required cooling air flow. The ventilators may have an adjustable rotational speed, as necessary for achieving the required cooling capacity.

Figure 2:
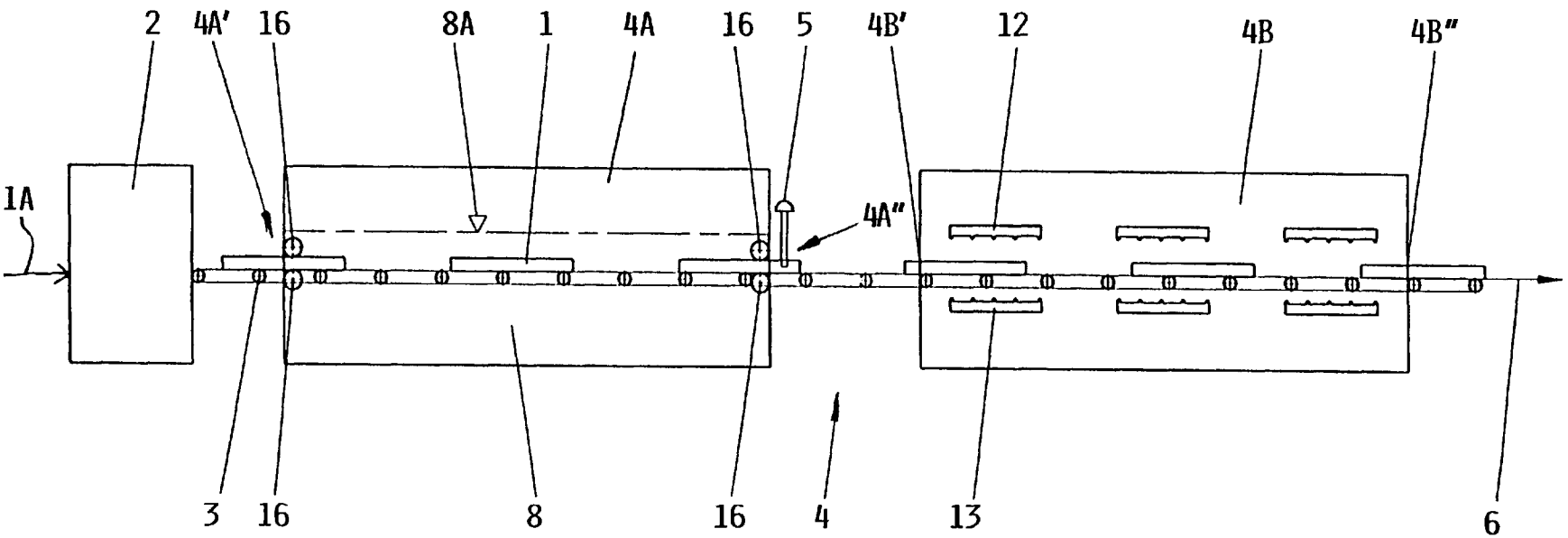
FIG. 2 is a schematic view similar to that of FIG. 1, but wherein the first cooling arrangement includes a water bath.

In the embodiment of FIG. 2, the first cooling arrangement 4A comprises a cooling water bath 8 instead of the water spray nozzles 7 described above in connection with FIG. 1. The water level 8A of this water bath 8 is maintained above the height of the transport plane 6 by any conventional water filling and level-maintaining devices. The inlet 4A' and the outlet 4A" of the cooling arrangement 4A are sealed by any suitable seal means 16 such as seal rollers or seal flaps to substantially avoid loss of the cooling water. Thus, in the present embodiment of FIG. 2, the first intensive cooling of the panels 1 is carried out by transporting the hot panels 1 coming out of the press 2 via a suitable conveyor device 3 through the seal means 16 into the cooling water bath 8, where the panels 1 are cooled, and then further transporting the panels out of the water bath 8. In this embodiment, a second cooling arrangement 4B corresponding to that described above in connection with FIG. 1 is arranged downstream from the first cooling arrangement 4A.

Figure 3:
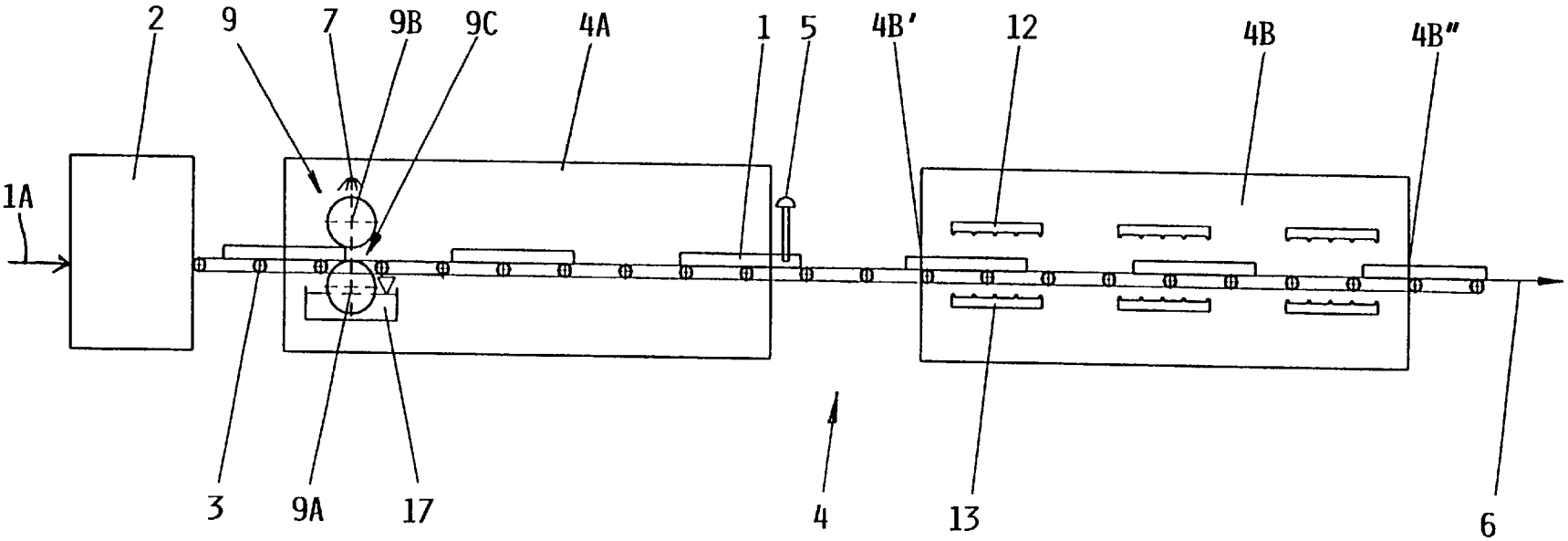
FIG. 3 is a schematic view similar to that of FIG. 1, but wherein the first cooling arrangement includes a cooling roller arrangement.

In another alternative embodiment shown in FIG. 3, the first cooling arrangement 4A comprises a cooling roller pair 9 arranged in the cooling chamber. The cooling roller pair 9 includes a bottom cooling roller 9A arranged below the transport plane 6, and an upper cooling roller 9B arranged above the transport plane 6 with its axis parallel to that of the lower cooling roller 9A. The lower cooling roller 9A rotates in a container or bath 17 containing a cooling medium, whereby the roller 9A is continuously wetted with the cooling medium. The upper cooling roller 9B is continuously wetted or sprayed with a cooling medium by at least one row of spray nozzles 7 arranged along the cooling roller 9B. The hot panels 1 in this embodiment are transported through and between the roller nip or gap 9C that exists or can be formed between the two rollers of the roller pair 9. In this manner, through contact with the cooled, wetted rollers, and by being thereby wetted themselves, the panels 1 are sufficiently cooled. The second cooling arrangement 4B arranged downstream from the first cooling arrangement 4A corresponds to that described above in connection with FIG. 1.

Figure 4:
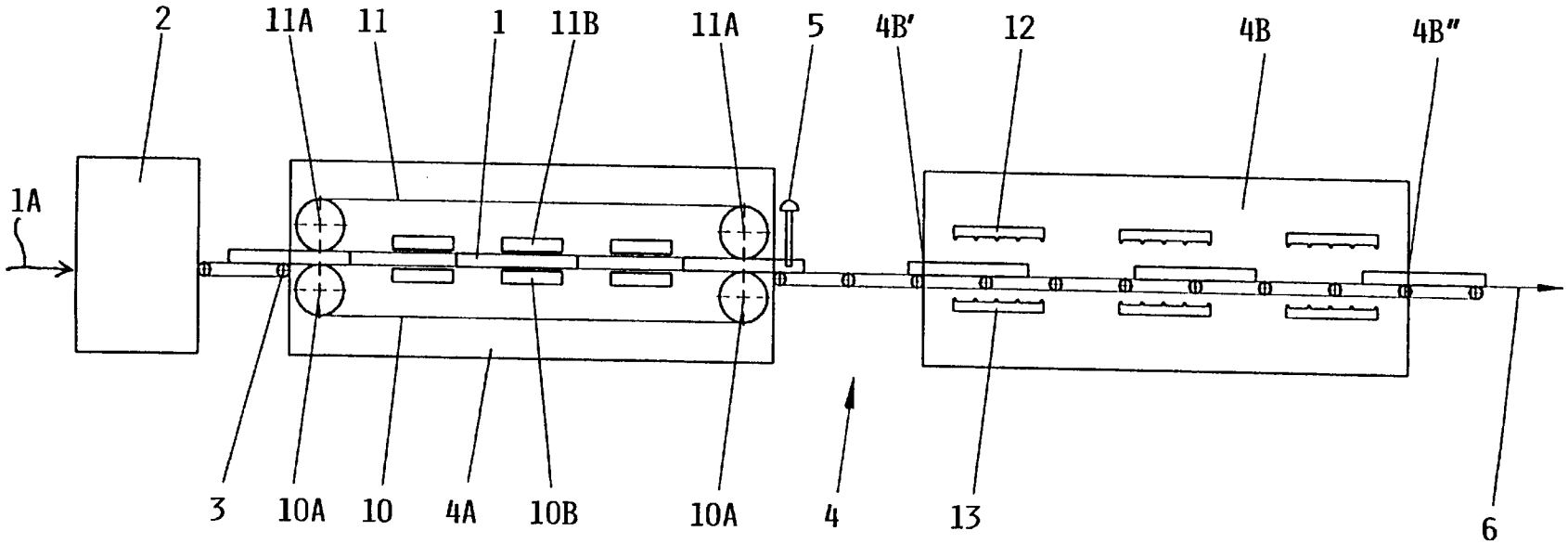
FIG. 4 is a schematic view similar to that of FIG. 1, but wherein the first cooling arrangement includes a cooling band arrangement.

FIG. 4 shows a further embodiment of the first cooling arrangement 4A, comprising a pair of endless metal bands 10 and 11 that are respectively arranged below and above the transport plane 6 so as to continuously run around respective rollers 10A and 11A, with an upper traveling strand of the lower band 10 in contact with the lower surface of the panel 1, and a lower travelling strand of the upper band 11 in contact with the upper surface of the panel 1. One or more cooling pockets 10B and 11B supplied with a flow of cooling medium are arranged between the respective drive and support rollers 10A and 11A, adjacent the respective strands or sides of the bands 10 and 11 in contact with the panels 1, so as to cool the respective strand or side of the endless bands 10 and 11 moving over the cooling pockets 10B and 11B. Thus, a respective heat exchange takes place, first between the surfaces of the panels 1 and the moving metal bands 10 and 11, and secondly between the moving metal bands 10 and 11 and the cooling pockets 10B and 11B. A second cooling arrangement 4B corresponding to that described above in connection with FIG. 1 is arranged downstream of the first cooling arrangement 4A comprising the endless metal bands 10 and 11.

As a further embodiment of the invention, the second cooling arrangement 4B can be embodied as a multi-story or multi-level cooling arrangement, in which each story or level of the cooling arrangement corresponds to the second cooling arrangement 4B as shown and described in connection with FIG. 1. Namely, a plurality of such cooling arrangements 4B are stacked on top of one another, and the conveyor device 3 works in cooperation with known turning devices to convey the panels 1 successively through each adjacent level or story of the second cooling arrangements 4B.

Figure 5:
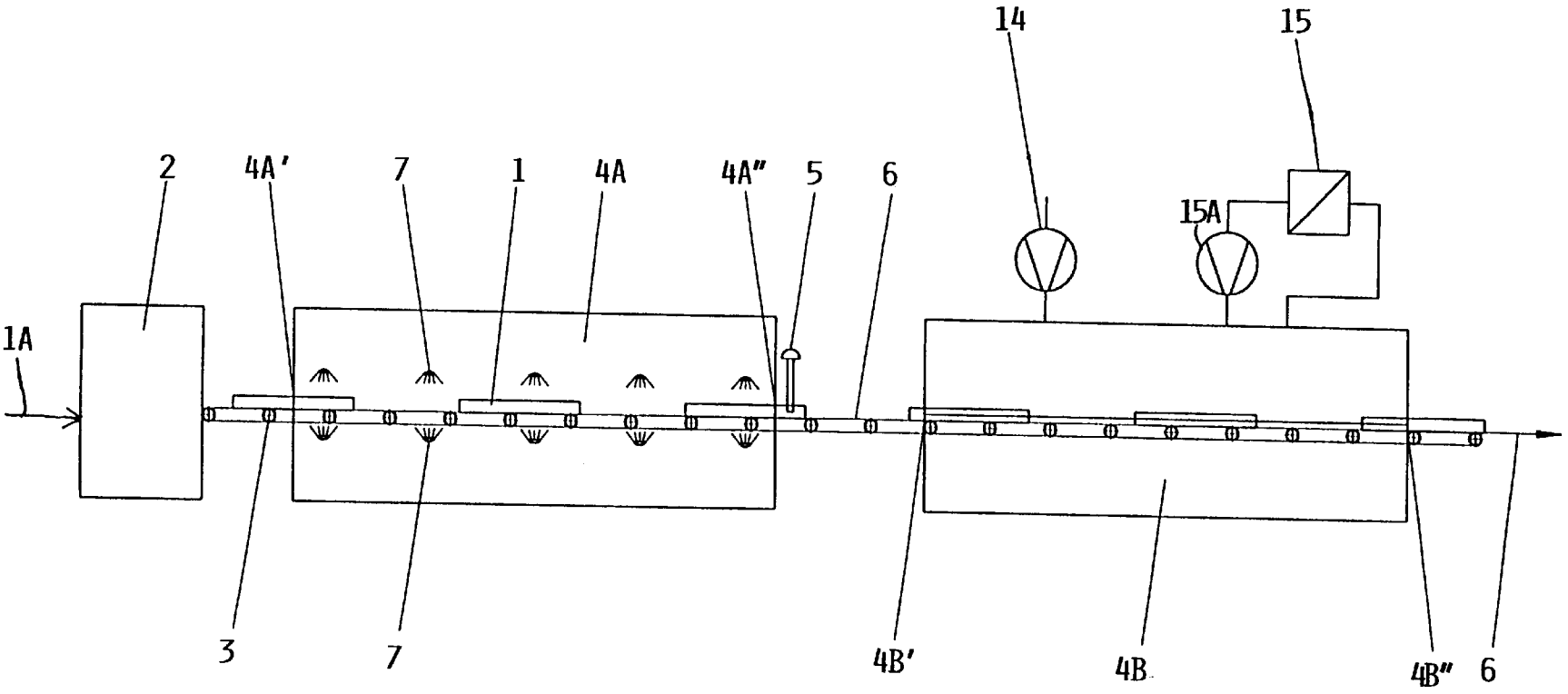
FIG. 5 is a schematic view similar to that of FIG. 1, but wherein the second cooling arrangement includes a heat exchanger or a cooling air ventilator.

Other possible embodiment details of the second cooling arrangement 4B are shown in FIG. 5. As a first alternative, an external cooling air ventilator 14 can be connected to the housing enclosing the cooling chamber of the second cooling arrangement 4B, so as to directly blow ambient cooling air into the second cooling arrangement 4B. As another alternative, at least one heat exchanger 15 is connected to a duct in a closed loop path with the cooling chamber, in order to indirectly cool the air or gas mixture that is circulated within the cooling arrangement 4B. The heat exchanger 15 in turn is cooled by any known cooling equipment, such as a water or fluid chiller, whereby the heater exchanger 15 is a liquid-to-air heat exchanger. The air or vapor mixture is circulated from the second cooling chamber through the heat exchanger 15 and back into the second cooling chamber by an associated blower 15A. As yet a further alternative, the second cooling arrangement 4B can be cooled directly by cooling air from the surrounding atmosphere, for example by natural convection or the like, without requiring a cooling air ventilator 14 or a heat exchanger 15.

In order to shorten the overall structural length of the cooling plant, the first cooling arrangement 4A and the second cooling arrangement 4B can be connected or combined together to form a single cooling arrangement that is provided with cooling water in a first portion or zone thereof and cooling air in a second portion or zone thereof. To make the apparatus even more compact, or to increase the throughput, either or both of the first cooling arrangement 4A and the second cooling arrangement 4B can be constructed wide enough in a direction perpendicular to the plane of the present drawings so that two or more of the panels 1 can be arranged side-by-side on the conveyor device 3 and transported through the cooling arrangements two or more abreast. Also, the two cooling arrangements 4A and 4B can be arranged side-by-side parallel to each other, with a panel turning device arranged between the outlet 4A" of the first cooling arrangement 4A and the inlet 4B' of the second cooling arrangement 4B.

According to a further embodiment of the invention, the hot pressed material coming out of the press 2 is not already in the form of separate panels 1, but is rather in the form of a continuous band or web, which is then cut into separate panels 1 either before or after passing through the intensive water cooling step, or even after passing through the air cooling step. The panel cutting equipment necessary for such a variation is not shown, but can be of any conventional type and configuration.

Figure 6:
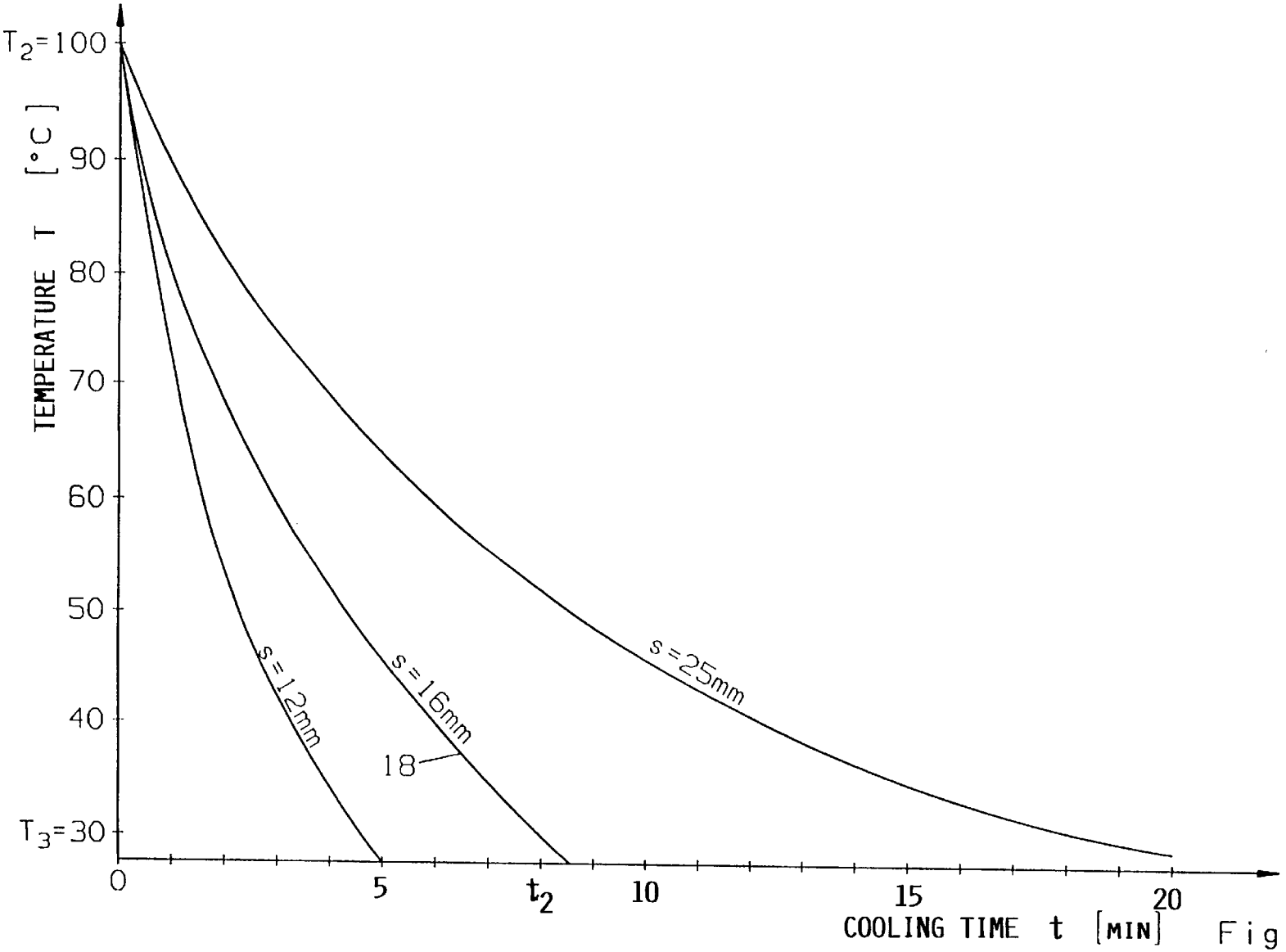
FIG. 6 is a cooling time diagram showing the temperature of the panels being cooled over time, as dependent on the thickness of the respective panel.

In the cooling time diagram of FIG. 6, the temperature T is shown in ° C. along the ordinate axis, and the cooling time t is shown in minutes along the abscissa axis. Particularly, this diagram relates to the cooling process carried out in the second cooling arrangement 4B. FIG. 6 shows three different cooling curves 18 for three different respective thicknesses s, namely 12 mm, 16 mm, and 25 mm, of the respective panels 1. Furthermore, the cooling curves 18 assume certain physical parameters, such as the thermal transfer coefficient $\alpha$, the specific heat cp, the thermal conductivity $\lambda$, the density $\gamma$, and the cooling air temperature in ° C., for example, whereby it is further assumed that the process begins with an average panel temperature of about 100° C. In other words, the panels 1 have previously been cooled from a temperature $T_1$>100° C. down to a temperature $T_2$ of approximately 100° C. in the first intensive water cooling step, which is not shown in the diagram of FIG. 6.

As can be seen from the diagram, the second air cooling step cools the panels from a temperature $T_2$ of approximately 100° C., down to a final temperature $T_3$ of about 30° C. in a time $t_2$ of about 4½ minutes for a panel having a thickness of 12 mm, in about 8 minutes for a panel having a thickness of 16 mm, and in about 19 minutes for a panel having a thickness of 25 mm. The intensive cooling of the first water cooling step proceeds even more quickly, whereby especially the time duration $t_1$ of the first step is preferably less than 5 minutes. Thus, it is clearly recognized that the inventive cooling process has achieved an enormous reduction in the total cooling time as compared to the conventional cooling techniques, as discussed above, which may require several days until the panels are cooled down to an ordinary room temperature such as 30° C.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method of cooling hot-pressed planar material having an initial temperature of at least 110° C., comprising:

a first cooling step of cooling at least one surface of said planar material from said initial temperature to an intermediate surface temperature of about 100° C. during a first time period using water as a cooling medium, wherein a vapor mixture including saturated water steam and a volatile binder component volatilized from said planar material is evolved during said first time period;

a second cooling step of cooling said at least one surface of said planar material from said intermediate surface temperature to a final surface temperature less than 60° C. during a second time period using air as a cooling medium; and a reconditioning step of at least partially reconditioning said planar material by exposing said planar material to said vapor mixture during a third time period.

2. The method according to claim 1, wherein said planar material comprises at least one panel of wood chip board including wood chips and said volatile binder component, or fiber board including fibers and said volatile binder component.

3. The method according to claim 1, wherein said cooling in said first cooling step is carried out at a first relatively higher cooling rate, and said cooling in said second cooling step is carried out at a second relatively lower cooling rate.

4. The method according to claim 1, wherein said reconditioning step begins and at least partially takes place during said first time period while said first cooling step is being carried out.

5. The method according to claim 1, wherein said reconditioning step is carried out between said first time period of said first cooling step and said second time period of said second cooling step.

6. The method according to claim 1, further comprising removing said vapor mixture away from said planar material after said third time period elapses.

7. The method according to claim 6, wherein said removing of said vapor mixture comprises sucking said vapor mixture away, and further processing said vapor mixture to remove at least some of said volatile binder component therefrom.

8. The method according to claim 1, wherein said third time period of said reconditioning step has a duration set responsive to and dependent on a thickness of said planar material.

9. The method according to claim 1, wherein said using of water as a cooling medium in said first cooling step comprises applying said water substantially uniformly onto and directly contacting first and second opposite ones of said surfaces of said planar material, and said using of air as a cooling medium in said second cooling step comprises actively directing said air substantially uniformly onto and directly contacting said first and second opposite surfaces.

10. The method according to claim 1, wherein said using of said water as a cooling medium in said first cooling step comprises spraying said water onto said surface of said planar material.

11. The method according to claim 1, wherein said using of said water as a cooling medium in said first cooling step comprises conveying said planar material through a bath of said water such that said surface of said planar material is submerged in said water.

12. The method according to claim 1, wherein said using of said water as a cooling medium comprises wetting a pair of rollers with said water and conveying said planar material between and in contact with said rollers.

13. The method according to claim 1, wherein said first time period has a duration of less than 5 minutes.

14. The method according to claim 1, wherein said final surface temperature is about 30° C., and said second time period has a duration that is less than 30 minutes and is dependent on a thickness of said planar material.

15. The method according to claim 1, wherein said planar material is a continuous band-shaped web that is continuously conveyed through a first cooling station where said first cooling step is carried out and a second cooling station were said second cooling step is carried out.

16. The method according to claim 1, wherein said planar material is initially a continuous band-shaped web that is cut into individual panels before said first cooling step, and wherein said planar material then comprises said individual panels that are cooled in said first and second cooling steps.

17. The method according to claim 1, wherein said planar material subjected to said first cooling step is a continuous band-shaped web, and said method further comprises a step of cutting said band-shaped web into a plurality of individual panels after said first cooling step, and wherein said individual panels are then subjected to said second cooling step.

18. The method according to claim 1, further comprising a step of turning over said planar material during or following at least one of said first and second cooling steps.

19. An apparatus for cooling hot-pressed planar material from an initial temperature above 100° C. to a final temperature below 70° C. in at least two successive cooling steps, comprising:

a hot panel press;

a conveyor device arranged adjacent said hot panel press and adapted to convey said planar material in a downstream direction from said hot panel press;

a first cooling arrangement that is adapted to cool said planar material from said initial temperature to an intermediate temperature in a first cooling step, and that is arranged in said downstream direction relative to said hot panel press, with said conveyor device extending through said first cooling arrangement;

a second cooling arrangement that is adapted to further cool said planar material from said intermediate temperature to said final temperature in a second cooling step, and that is arranged in said downstream direction relative to said first cooling arrangement, with said conveyor device extending through said second cooling arrangement;

a reconditioning zone that is adapted to recondition said planar material, and that is arranged along said conveyor device; and a controller that includes at least one sensor arrangement and that is connected to said first and second cooling arrangements and adapted to control the operation thereof;

wherein said conveyor device is adapted to convey said planar material in a transport plane through said first cooling arrangement, said second cooling arrangement and said reconditioning zone.

20. The apparatus according to claim 19, wherein said reconditioning zone is arranged between said first cooling arrangement and said second cooling arrangement.

21. The apparatus according to claim 19, wherein said reconditioning zone is integrated in said first cooling arrangement and said second cooling arrangement.

22. The apparatus according to claim 19, wherein said first cooling arrangement comprises a source of cooling water and is adapted to carry out said first cooling step using said cooling water.

23. The apparatus according to claim 22, wherein said second cooling arrangement comprises a cooling air ventilator system arranged to blow said cooling air onto said planar material.

24. The apparatus according to claim 19, wherein said second cooling arrangement comprises an active driven source of cooling air and is adapted to carry out said second cooling step using said cooling air.

25. The apparatus according to claim 19, wherein said first cooling arrangement comprises at least one upper row of water spray nozzles arranged above said transport plane and extending across said downstream direction, and at least one lower row of water spray nozzles arranged below said transport plane and extending across said downstream direction.

26. The apparatus according to claim 19, wherein said first cooling arrangement comprises a water bath arranged with said conveyor device extending therethrough and adapted to contain cooling water with a water level above said transport plane.

27. The apparatus according to claim 19, wherein said first cooling arrangement comprises an upper cooling roller and a lower cooling roller arranged parallel to each other respectively above and below said transport plane, a water spray nozzle arranged and adapted to spray cooling water onto said upper cooling roller, and a water trough arranged below and partially surrounding said lower cooling roller.

28. The apparatus according to claim 19, wherein said first cooling arrangement comprises respective upper and lower endless-loop steel cooling bands respectively arranged above and below said transport plane.

29. The apparatus according to claim 28, further comprising respective upper and lower cooling pockets that are connected to a source of cooling water and that are respectively arranged between upper and lower band strands of each of said upper and lower cooling bands.

30. The apparatus according to claim 19, wherein said second cooling arrangement comprises an upper row of air nozzles arranged above said transport plane extending across said downstream direction, and a lower row of air nozzles arranged below said transport plane and extending across said downstream direction.

31. The apparatus according to claim 19, wherein said second cooling arrangement consists of a single cooling level on said transport plane.

32. The apparatus according to claim 19, wherein said second cooling arrangement comprises a plurality of cooling levels arranged one above another, with only one of said cooling levels arranged on said transport plane.

33. The apparatus according to claim 19, wherein said second cooling arrangement comprises a cooling air ventilator arranged to directly suck ambient air from the environment around said second cooling arrangement.

34. The apparatus according to claim 19, wherein said second cooling arrangement includes a cooling air recirculation duct and a heat exchanger interposed in said cooling air recirculation duct.

35. The apparatus according to claim 19, wherein said sensor arrangement includes a respective temperature sensor respectively arranged at a respective outlet end of said first cooling arrangement and of said second cooling arrangement.

36. The apparatus according to claim 19, wherein said second cooling arrangement is positioned parallel and next to said first cooling arrangement, and said apparatus further comprises a material turning station arranged between said first and second cooling arrangements.

37. The apparatus according to claim 19, further comprising a panel cutting device arranged between said first and second cooling arrangements and adapted to cut a continuous web of said planar material into individual panels of said planar material.

* * * * *